US007566097B2

(12) United States Patent
Sander et al.

(10) Patent No.: US 7,566,097 B2
(45) Date of Patent: Jul. 28, 2009

(54) CHAIR, IN PARTICULAR OFFICE CHAIR

(76) Inventors: Armin Sander, Flössaustrasse 86 d, Fürth (DE) D-90763; Christopher Schmidt, Johannisstrasse 75, Nürnberg (DE) D-90419

( * ) Notice: Subject to any disclaimer, the term of this patent is extended or adjusted under 35 U.S.C. 154(b) by 0 days.

(21) Appl. No.: 11/861,415

(22) Filed: Sep. 26, 2007

(65) Prior Publication Data

US 2008/0088163 A1 Apr. 17, 2008

Related U.S. Application Data

(63) Continuation of application No. PCT/EP2006/002450, filed on Mar. 17, 2006.

(30) Foreign Application Priority Data

Mar. 26, 2005 (DE) ..... 202005004880

(51) Int. Cl.
*A47C 1/038* (2006.01)

(52) U.S. Cl. ..... 297/300.2; 297/300.5; 297/300.6; 297/300.7; 297/303.1

(58) Field of Classification Search ..... 297/300.2, 297/300.5, 300.6, 300.7, 303.1
See application file for complete search history.

(56) References Cited

U.S. PATENT DOCUMENTS

| | | | | |
|---|---|---|---|---|
| 3,672,721 | A * | 6/1972 | Williams | 297/303.1 |
| 5,080,318 | A * | 1/1992 | Takamatsu et al. | 248/598 |
| 5,308,144 | A | 5/1994 | Korn | |
| 5,348,372 | A * | 9/1994 | Takamatsu et al. | 297/303.1 |
| 5,584,533 | A | 12/1996 | Schrewe | |
| 5,649,740 | A * | 7/1997 | Hodgdon | 297/303.1 |
| 6,238,000 | B1 | 5/2001 | Hallmark et al. | |
| 6,692,075 | B2 | 2/2004 | Sander et al. | |
| 6,896,329 | B2 | 5/2005 | Sander et al. | |
| 7,066,538 | B2 * | 6/2006 | Machael et al. | 297/300.2 |
| 7,425,037 | B2 * | 9/2008 | Schmitz et al. | 297/300.2 |
| 2001/0024057 | A1 | 9/2001 | Heidt | |
| 2002/0195856 | A1 | 12/2002 | Caruso et al. | |

FOREIGN PATENT DOCUMENTS

| | | | |
|---|---|---|---|
| DE | 4312113 | C1 | 10/1994 |
| DE | 19619567 | A1 | 11/1997 |
| DE | 19950923 | A1 | 4/2001 |
| DE | 10122946 | C1 | 1/2003 |
| DE | 10122948 | C1 | 3/2003 |
| EP | 0399251 | A1 | 11/1990 |
| EP | 0934716 | A2 | 8/1999 |

* cited by examiner

*Primary Examiner*—Laurie K Cranmer
(74) *Attorney, Agent, or Firm*—Laurence A. Greenberg; Werner H. Stemer; Ralph E. Locher

(57) ABSTRACT

A seat, in particular an office chair, has a synchronous mechanism with a weight-adapting mechanism. An automatic adaptation of a spring force acting on the synchronous mechanism depends on the weight momentarily exerted on the seat. Therefore, the spring force is transmitted to the synchronous mechanism via a lever whereof the active arm length of the lever can be modified to adjust the spring force. The weight-adapting mechanism is configured such that the active arm length is automatically adapted to the weight momentarily exerted on the seat.

11 Claims, 7 Drawing Sheets

CHAIR, IN PARTICULAR OFFICE CHAIR

CROSS-REFERENCE TO RELATED APPLICATIONS

This is a continuing application, under 35 U.S.C. § 120, of copending international application No. PCT/EP2006/002450, filed Mar. 17, 2006, which designated the United States; this application also claims the priority, under 35 U.S.C. § 119, of German patent application DE 20 2005 004 880.1, filed Mar. 26 2005; the prior applications are herewith incorporated by reference in their entirety.

BACKGROUND OF THE INVENTION

Field of the Invention:

The invention concerns a chair, in particular an office chair, with a synchronous mechanism.

Modern, high-quality office chairs are typically provided with a synchronous mechanism that ensures that the seat moves synchronously with the backrest. The synchronous mechanism typically contains a seat support and a backrest support as well as sliding guides and/or rotary joint arrangements by which these two parts are connected with each other and with the seat and/or backrest. The synchronous mechanism is configured such that movement of the backrest also results in a change in the position of the seat. If the backrest is tilted, the seating area is also tilted backward and downward. Various configuration variants are available for the synchronous mechanism. Office chairs with synchronous mechanisms can be found, for example, in German patents DE 101 22 946 C1 or DE 101 22 948 C1 corresponding to U.S. Pat. Nos. 6,692,075 and 6,896,329, respectively.

In order to ensure a high level of comfort for the user of the chair, its mechanical properties, in particular the return force acting on the backrest, are adjusted depending on the weight of the user. If the same chair is used by different users of different weights, then a simple adjustment to the current weight in each case is desired. One possibility, for example, is to adjust the spring pretension of a return element using a manual adjustment mechanism.

BRIEF SUMMARY OF THE INVENTION

It is accordingly an object of the invention to provide a chair, in particular an office chair, which overcomes the above-mentioned disadvantages of the prior art devices of this general type, which has a synchronous mechanism with an improved level of comfort.

The object is achieved according to the invention by a chair, in particular an office chair, which is configured with both a weight-adjusting mechanism and a synchronous mechanism. A return force that is dependent on the current weight load is applied to the synchronous mechanism and is transmitted by a lever. The effective lever arm length of the lever can be changed to adjust the return force. The weight-adjusting mechanism is configured such that the effective lever arm length is automatically adjusted to the current weight load.

An automatic weight adjustment is thus achieved by this configuration. Manual adjustment is not required. A significantly higher level of comfort is thereby achieved. Since the amount of the return force is adjusted by varying the length of the lever arm, the adjustment force applied by a return element acts only indirectly on the synchronous mechanism. A decoupling of the return element that generates the adjustment force and the synchronous mechanism is thus achieved.

The weight-adjusting mechanism and the synchronous mechanism are therefore preferably functionally independent of each other, in such a manner that the weight-adjusting mechanism has no effect on the functional interaction of the individual components of the synchronous mechanism, other than to adjust the return force. With this functional separation, the synchronous motion path defined by the synchronous mechanism between the seat and the backrest is independent of the weight adjustment, and when the synchronous mechanism is actuated, for example, the seating area is not raised.

According to an expedient embodiment, the effective lever length is defined by the distance between a fixed lever fulcrum and a pivoting element of the synchronous mechanism. The pivoting element can be movably guided relative to the fixed location of the lever fulcrum. Since the synchronous mechanism is connected to the seat, when the seat is loaded such that the height of the seat changes, this results in the lever arm length being affected in a simple manner depending on the weight. In principle, the pivoting element can also be fixed in location and the position of the lever fulcrum can be changed.

In an expedient embodiment, the pivoting element is connected to a backrest support of the synchronous mechanism and the backrest support, together with the seat support, is movably mounted in a guide, in particular in a common housing. Under a weight load, the seat support with the backrest support is pushed downward in the guide, such that the distance between the pivoting element and the fixed lever fulcrum is changed. This allows a compact and simple mechanical construction.

To transfer the return force from the lever to the backrest support, and thus to the backrest, the pivoting element is preferably disposed relative to the backrest support such that when the backrest is tilted the pivoting element pushes the lever away, against its return force.

In consideration of a simple configuration solution, the backrest support is rotatably mounted on a rotary axis and the pivoting element is set at a distance from the rotary axis. When the synchronous mechanism is actuated, that is, when the backrest is tilted downward and backward, the backrest is rotated somewhat about the rotary axis. Due to its distance, the pivoting element is guided along a circular path against the lever such that it makes a pivoting motion about its lever fulcrum. The angular range that is thereby covered by the lever depends on the effective lever arm length.

The lever preferably features a contact surface for the pivoting element that extends along its lever arm. The contact surface thereby advantageously forms a sliding guide for the pivoting element. The contact surface is, for example, an exterior side of the lever, or a slot in the lever. For an exterior contact surface in particular, the contact between the pivoting element and the lever is reduced to a necessary minimum dimension.

Expediently, the contact surface is generally vertically oriented, at least when the synchronous mechanism is not loaded. The pivoting element therefore defines a pivoting point that can be slid freely past the lever to adjust and define the effective lever arm length. This configuration achieves a zero-force adjustment of the effective lever arm length; that is, no forces must be overcome in order to vary the lever arm length.

In order to achieve, with a simple configuration, zero-force adjustment of the effective lever arm length when the synchronous mechanism is unloaded, the rotary axis and the fixed lever fulcrum are disposed, according to a preferred further development, in an at least a generally vertical line.

The return force applied to the backrest by the lever is preferably generated by a return element, in particular a spiral spring, one free end of which is connected to the lever in such a manner that the return element is tensioned or relaxed as the lever is rotated. The desired characteristic of the return force is thus adjusted in a simple manner by the return element, in particular the spring.

In order to allow a defined change depending on the current weight of the user, according to an expedient further development, a weight return element is provided that applies a return force to the seat support, against the force of the weight of the user. The change in position of the pivoting element is thus adjusted by the weight return element depending on the current weight load. The weight return element hereby conveniently features a non-linear spring characteristic, in particular such that the spring force increases with increasing spring displacement. The non-linear spring characteristic ensures that sufficient sensitivity is provided even for light persons.

According to an expedient further development, a locking device is provided that is configured such that the current effective lever arm length is fixed when the synchronous mechanism is actuated. This fixing ensures that actuation of the synchronous mechanism does not lead to a change in return force due to a change in the effective lever arm length.

The locking device preferably includes a moveable locking element that is held in an open position when the synchronous mechanism is unloaded, and is released from the open position, in particular reversibly, and moved under a spring load into a locking position when the synchronous mechanism is actuated. The locking device is therefore configured such that locking takes place only after the synchronous mechanism is actuated. A release or blocking element that holds the moveable locking element in its open position is provided in particular for this purpose. This blocking element is expediently located on a movable part of the synchronous mechanism, in particular on the backrest support. Since the locking element must be released at first when changing users, in order to allow automatic weight adjustment again, it is simultaneously provided that the moveable locking element is returned to the open position by a further return element as soon as the synchronous mechanism is no longer used; that is, as soon as the backrest support is returned to the original position. The locking device therefore fixes the position of the pivoting element only as long as the synchronous mechanism is actuated, in order to prevent the lever arm length from being changed while the synchronous mechanism is actuated.

Other features which are considered as characteristic for the invention are set forth in the appended claims.

Although the invention is illustrated and described herein as embodied in a chair, in particular an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE DESCRIPTION

Figure 1B:
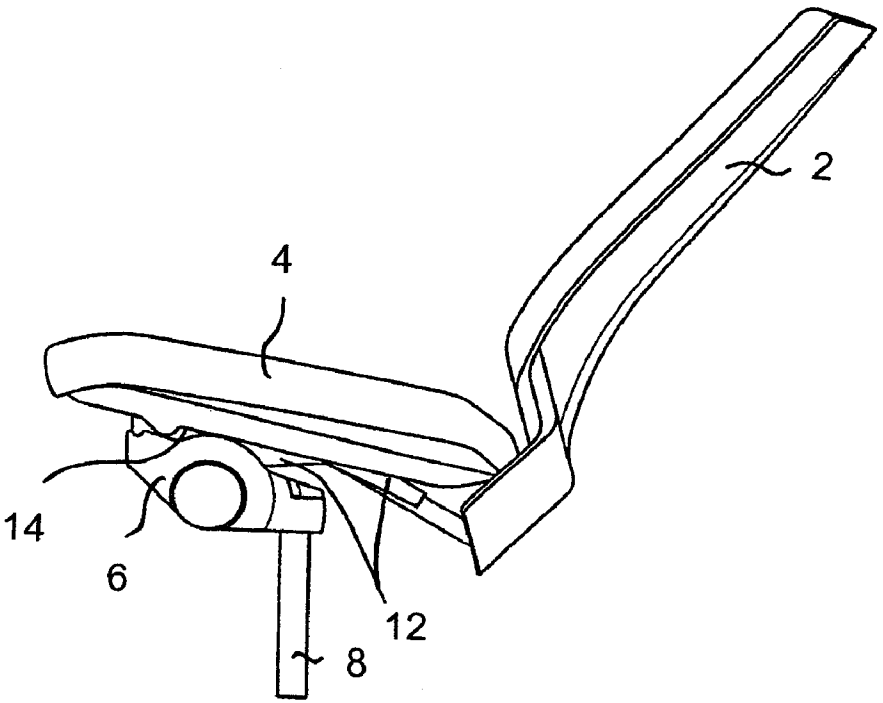
FIG. 1B is a diagrammatic, side view of the office chair in a loaded condition, with an actuated synchronous mechanism and a tilted backrest.
Figure 1A:
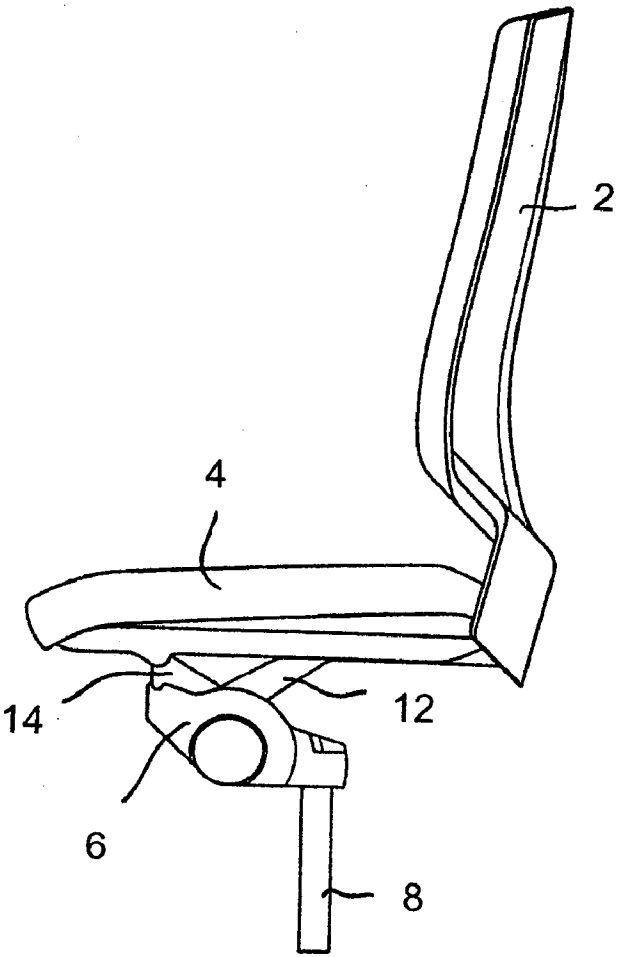
FIG. 1A is a diagrammatic, side view of an office chair with a synchronous mechanism according to the invention.

Components with the same effect are provided with the same reference markers in the figures of the drawing. Referring now to the figures of the drawing in detail and first, particularly, to FIGS. 1A and 1B thereof, there is shown a rotating office chair with a synchronous mechanism. The chair has a backrest 2, a seat 4, a housing 6 mounted below the seat 4, in which the individual mechanical components that make up the synchronous mechanism and a weight-adjusting mechanism are at least partially integrated, as well as a stanchion 8 that is connected to a non-illustrated foot component. The rotating office chair is provided with a synchronous mechanism so that the movement of the seat 4 and the backrest 2 are coupled to each other. When the backrest 2 is adjusted from the position shown in FIG. 1A to the position shown in FIG. 1B, the seat 4 is moved from a generally horizontal position per FIG. 1A into the position that is tilted diagonally backward. In the following, the phrase "actuated synchronous mechanism" is understood to mean a condition in which the backrest 2 is tilted at least partially backward, and the seat 4 is correspondingly tilted diagonally backward, as is shown in FIG. 1B.

The synchronous mechanism contains in particular a backrest support 12 by which the backrest 2 is mounted. The synchronous mechanism further includes a seat support 14, which supports the seat 4.

There are principally different possible solutions for the configuration of the synchronous mechanism. In the exemplary embodiment shown, a preferred configuration is indicated. In general for a synchronous mechanism, the seat support 14 and the backrest support 12 are connected pivotally or by a sliding configuration. The connection of the individual elements takes place at so-called pivoting points. As can be seen in particular in FIG. 2A through 3B, in the application example the seat support 14 is guided at its front end in a slot 16 on the seat 4 (first pivoting point). The seat support 14 and the backrest support 12 are rotatably connected to each other about a rotary axis 18 (FIG. 2B) (second pivoting point). Further, the backrest support 12 is connected to the seat 4 at its rear part via a further pivoting joint 20.

As can be seen in FIGS. 2A through 3B, a lever 22 is provided for the construction of the synchronous mechanism and a combined weight-adjusting mechanism, which lever is rotatably mounted at a fixed lever fulcrum 24. The lever 22 is attached to the housing 6. In the exemplary embodiment, a spring element configured as a spiral spring 26 exerts an elastic return force on the lever 22 in a counter-clockwise direction. The spiral spring 26 is connected at one free end to the lever 22 above the lever fulcrum 24. In the exemplary embodiment, the second free end contacts a contact surface on the lever, not shown in much detail here. Movement of the lever 22 in a clockwise direction causes tension in the spiral spring 26.

The area of the lever 22 above the lever fulcrum 24 contains a lever arm. This is generally or precisely vertical in the unloaded state, that is, when the synchronous mechanism is not actuated. The left outside edge of the lever arm has a contact surface 30, for guiding a pivoting element 32, configured as a sliding stud or a roller, and supported by the backrest support 12. The pivoting element 32 slides along the contact surface 30 to vary the effective lever arm length. The sliding guide 30 is vertical when the synchronous mechanism is unloaded. At its upper and lower end, the lever arm features a step that limits the sliding or rolling travel of the pivoting element 32 above and below.

The pivoting element 32 is mounted on the backrest support 12, offset from the rotary axis 18. Furthermore, the rotary axis 18 is disposed on a common vertical line with the lever fulcrum 24. In combination with the vertical orientation of the sliding guide 30, this allows zero-force adjustment of the position of the pivoting element 32.

Furthermore, a weight return element is provided in the exemplary embodiment as a foam element 34, which is supported on one side by the floor of the housing 6, and on the other by the seat support 14, and applies a return force to the latter in the vertical direction. As an alternative to the foam element 34, a spring element can also be used as a weight return element. The foam element 34 has a non-linear spring characteristic, in which increasing displacement, that is, increasing compression of the foam element 34, also increases the spring hardness.

The seat support 14 is guided in the vertical direction within the housing 6 by at least one guide 35. In the exemplary embodiment, the seat support 14 features guide pins that are guided in a type of guide track in the front and rear areas. In the exemplary embodiment, the seat support 14 has approximately a trapezoidal cross section, where its front face trapezoidal surface is oriented vertically and can slide along a vertical interior wall of the housing 6. Due to this forced guidance in the housing 6, the seat support 14—and along with it, the backrest support 12—is slid in parallel from an upper position into a lower position (see also FIGS. 2A, 3A).

A locking mechanism is also provided that contains two locking elements that form a latching block, namely a fixed locking element 36*a* and a locking element 36*b* that is rotatably mounted about another rotary axis 38. The locking element 36*a* is rigidly connected to the housing 6, while the locking element 36*b* is rotatably mounted to the seat support 14, and with the seat support 14 is movable in the vertical direction. The two locking elements 36*a*, 36*b* feature interlocking tooth elements that lock the relative position of the locking elements relative to one another in the vertical direction, and thus lock the vertical position of the seat support 14. In the exemplary embodiment, the side of the locking element 36*a* that is oriented toward the rotatable locking elements 36*b* is configured like a comb, and correspondingly, the rotatable element 36*b* has at least one locking tooth on its lower end. In general, a positive locking fit that acts in the vertical direction is formed between the two locking elements 36*a*, 36*b*.

A spring element configured as a leaf spring 40 applies a return force to the rotatable locking element 36*b*, such that it is pressed against the fixed locking element 36*a* into a locking position. To do this, the one free end of the leaf spring 40 acts as a lever extension above the additional rotary axis 38, in order to apply a torque to the rotatable locking element 36*b*.

Figure 2A:
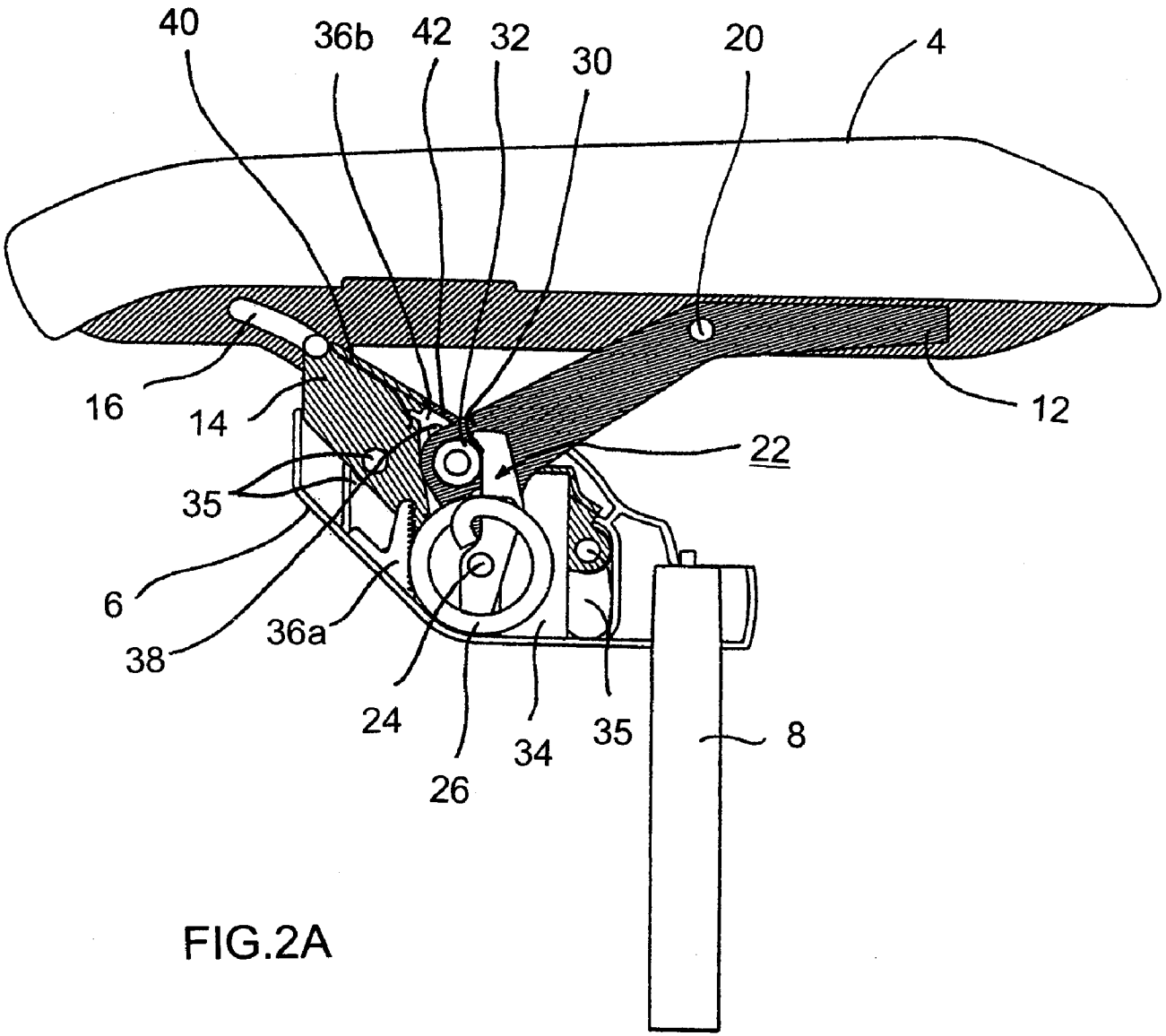
FIG. 2A is an enlarged detail view of the office chair in the area of the seat, for clarification of the synchronous and weight-adjusting mechanisms in case of a light weight load from a light person.
Figure 2B:
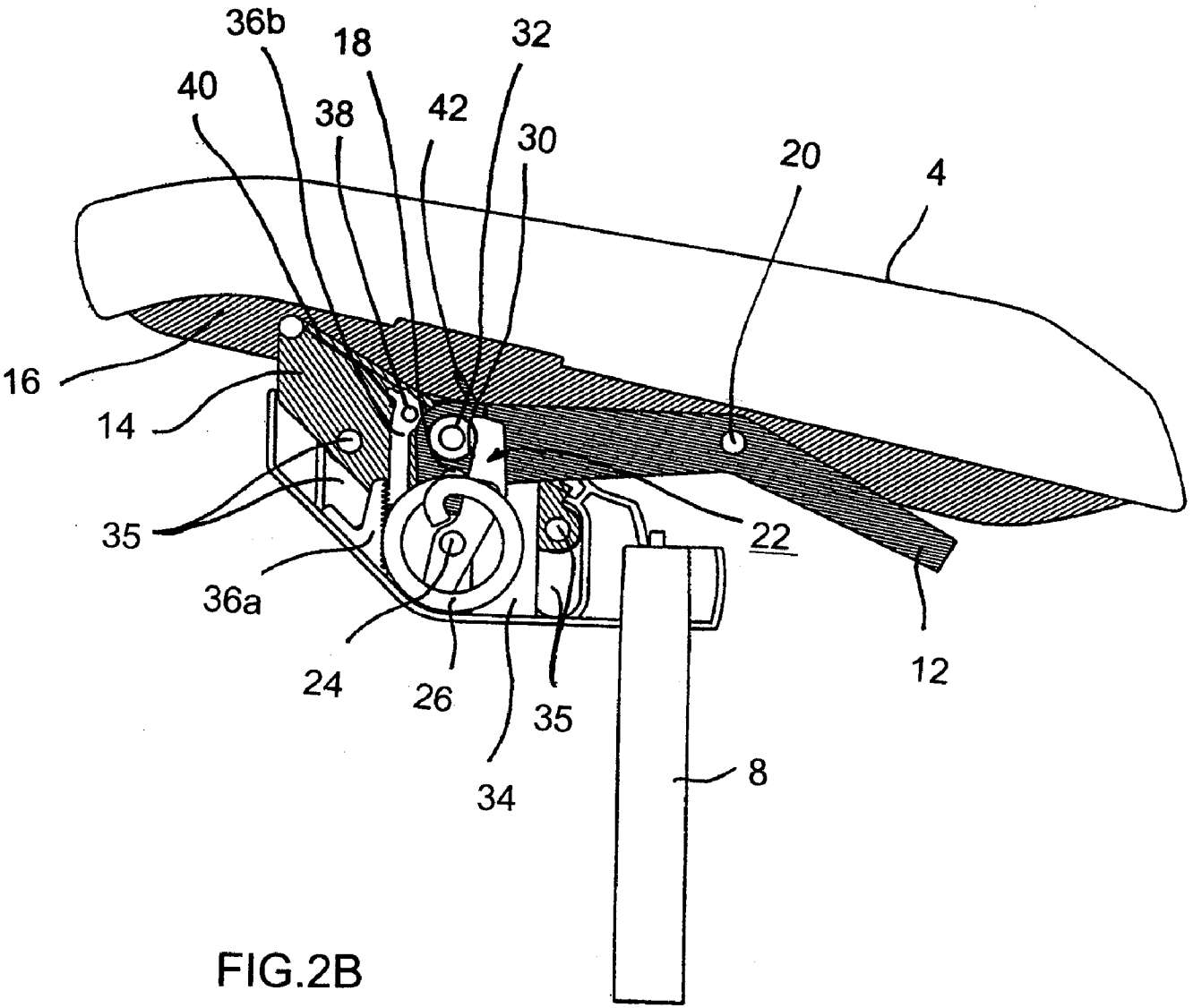
FIG. 2B is a representation as in FIG. 2A with an actuated synchronous mechanism.
Figure 3A:
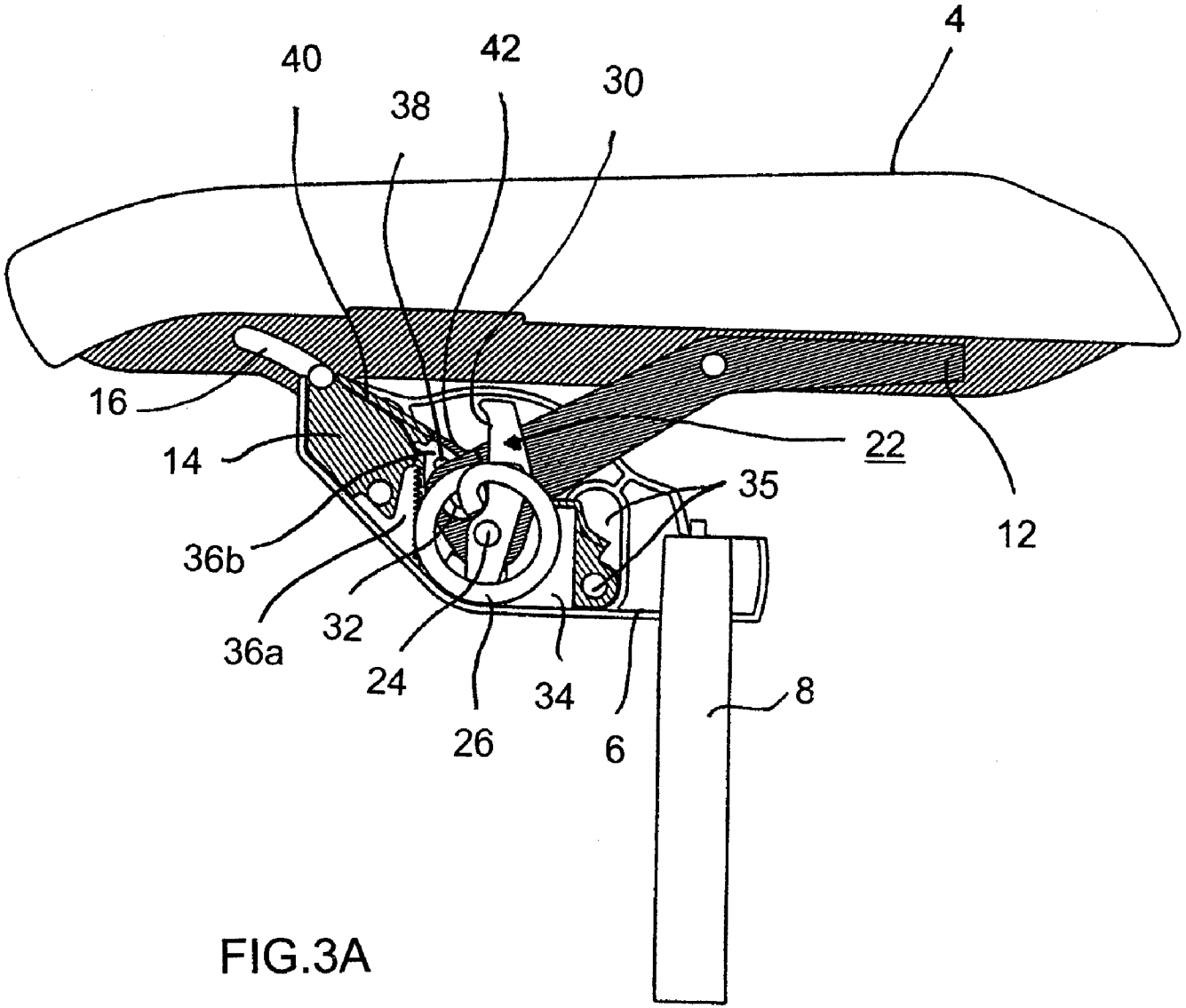
FIG. 3A is a detail view of the office chair in the area of the seat, for clarification of the synchronous and weight-adjusting mechanisms in case of a high weight load by a heavy person.

The locking element 36*b* is simultaneously held in the open position, in the position shown in FIGS. 2A, 3A, against the force applied by the leaf spring 40, by a latch and release element 42. The latch element 42 is configured as a lug that is offset from and connected to the backrest support 12, which contacts an upper front face contact area on the locking element 36*b* in the position shown in FIG. 2A and 3A, when the synchronous mechanism is unloaded.

Figure 3B:
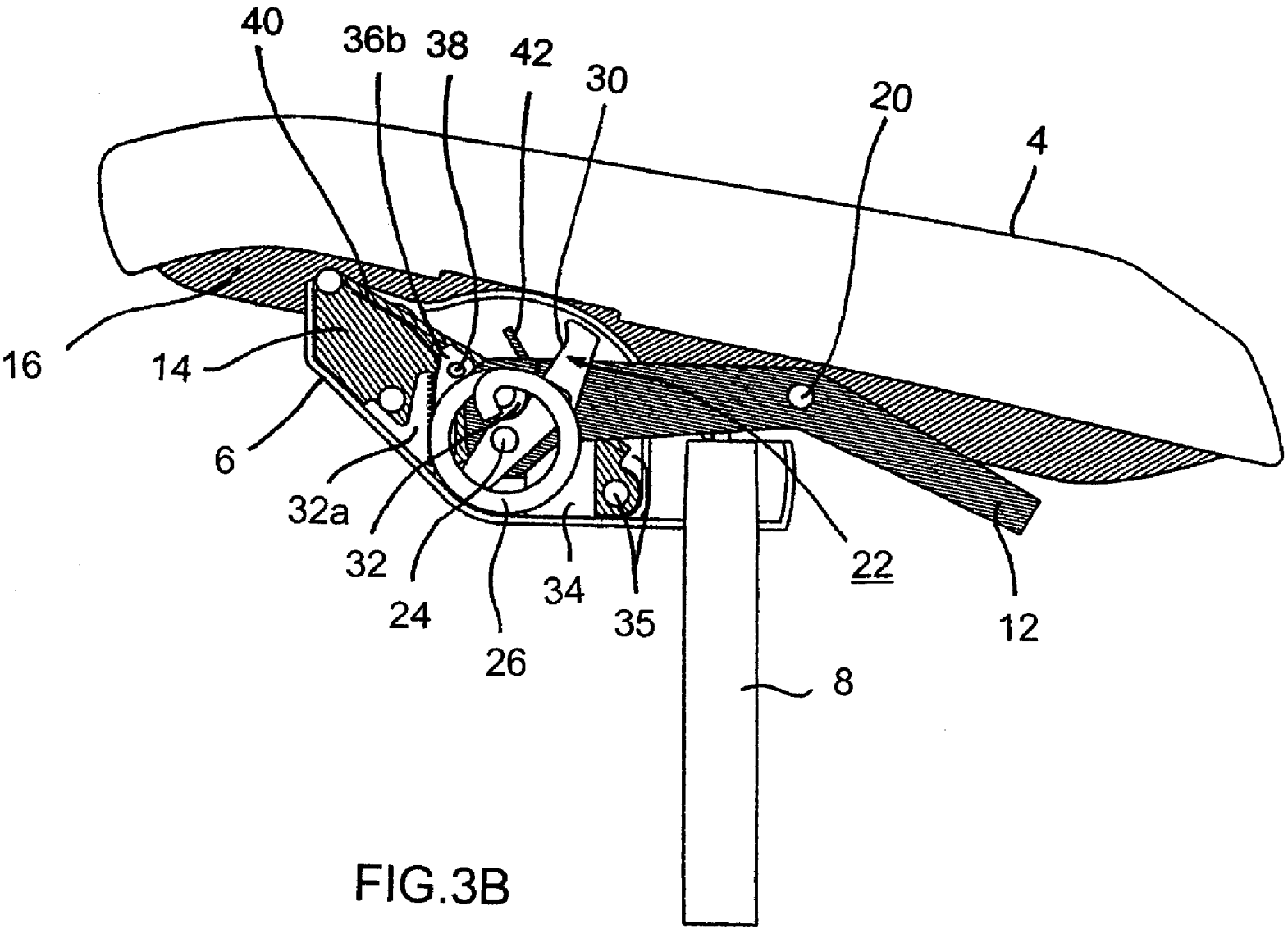
FIG. 3B is a representation as in FIG. 3A with the actuated synchronous mechanism.
Figure 4A:
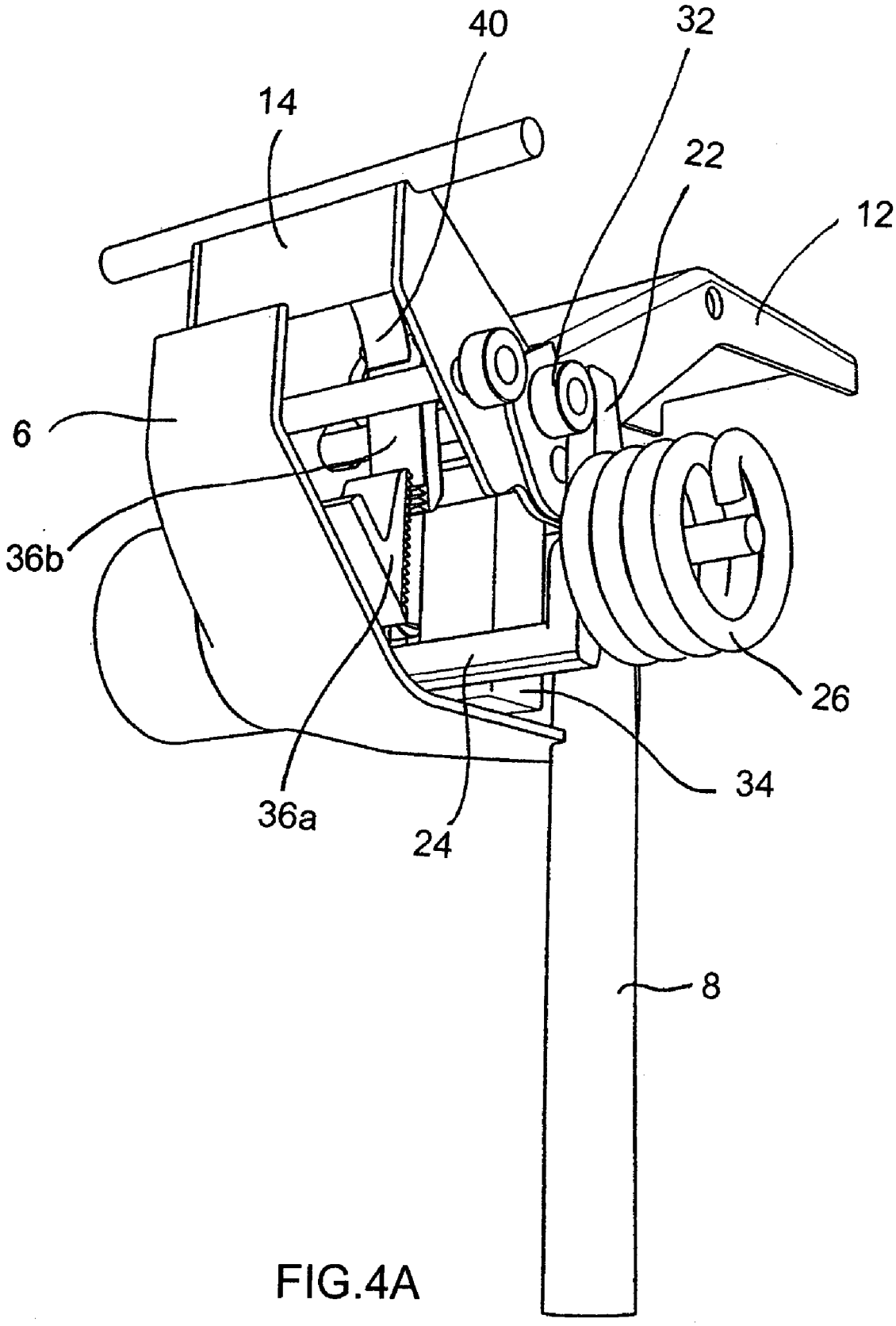
FIGS. 4A and 4B are perspective views of a modified version with partially a exploded housing.
Figure 4B:
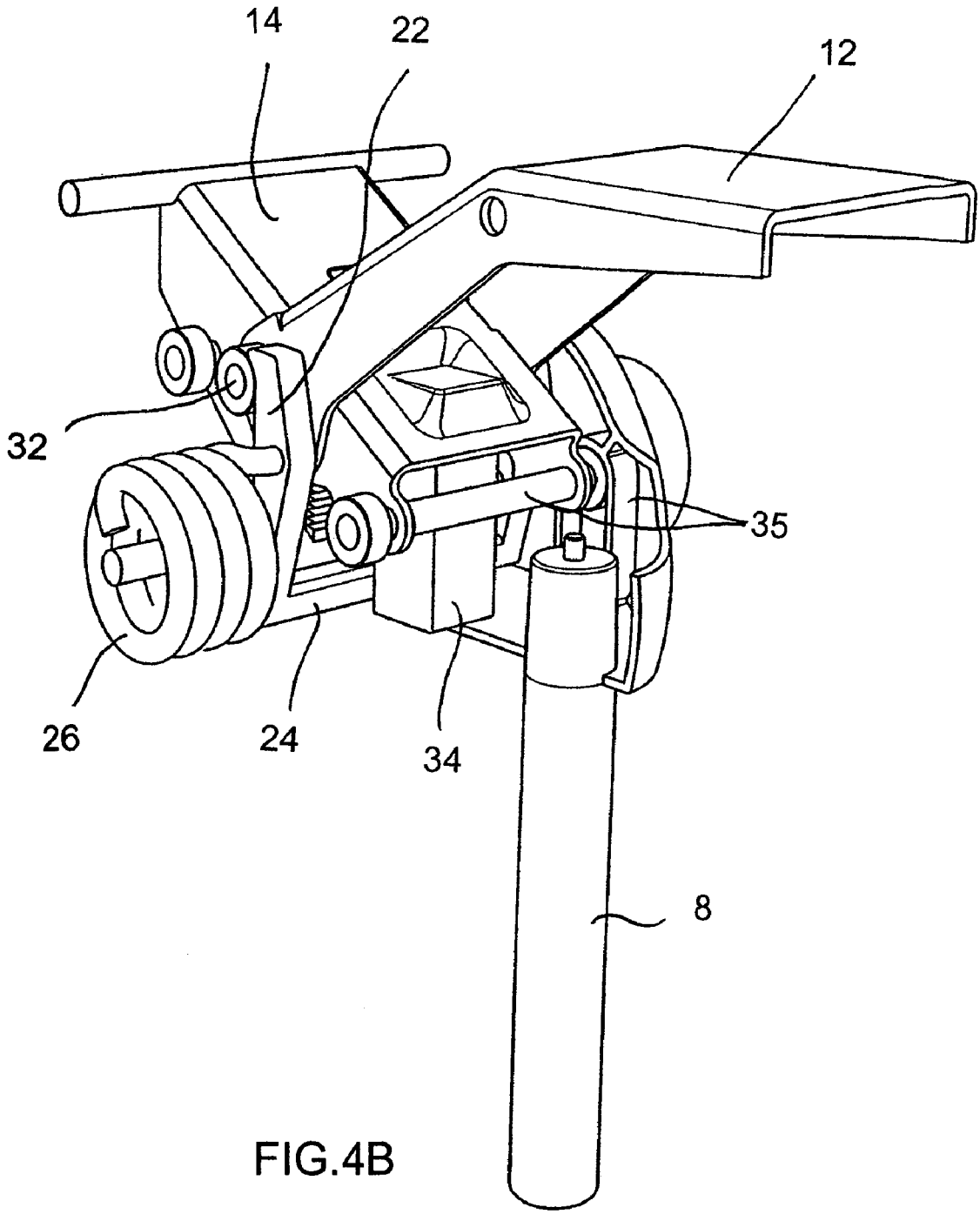

The operating method of the automatic weight adjustment, that is, the automatic adjustment of the return force that acts on the backrest when the synchronous mechanism is actuated, is described in more particular detail using FIGS. 2A through 3B. Further details can be found in the perspective representation of FIGS. 4A, 4B. FIGS. 2A, 2B show the office chair when it is lightly loaded, that is, when a light person is seated on the seat. FIGS. 3A, 3B, in contrast, show the office chair under a heavy load, that is, when a heavy person is using it.

The automatic weight adjustment is based largely on a change in the effective length of the lever arm. The effective lever arm length is formed here by the distance between the lever fulcrum 24 and the pivoting element 32. Under a light load (light person), a long effective lever arm length is automatically set, and the pivoting element 32 is positioned at the upper or uppermost area of the lever 22 (FIG. 2A). The force needed to move the lever 22 into a rearward position (FIG. 2B) is therefore relatively low, and the backrest 2 can be moved easily. In contrast, under a heavy load (heavy person, FIGS. 3A, 3B), the effective lever arm length is shortened and the pivoting element 32 makes contact at the lower area of the lever 22, or at the lowest area immediately above the lever fulcrum 24. The force that is needed to shift the lever 22 into the rest position is thus greatly increased, and the backrest 2 is relatively difficult to move backward and downward.

The path travelled by the pivoting element 32 to move the backrest 2 into the tilted end position is independent of the weight load.

This path is generally determined in the exemplary embodiment by the distance between the rotary axis 18 and the pivoting element 32. This distance forms another lever arm. The contact element thus moves along a circular path. The rotary axis 18 is preferably on a common vertical axis with the lever fulcrum 24. Since the path travelled by the pivoting element 32 remains constant, independent of the effective lever arm length of the lever arm, the angle travelled by the lever 22 is much greater for a heavy load than for a lighter load.

In this manner, the weigh-dependent adjustment of the return force is doubly effective. For a heavy weight load, on one hand, a higher return moment is required due to the shorter effective lever arm length. On the other, in addition—for the identical distance of adjustment of the backrest 2, from the upright position to the tilted end position—somewhat significantly greater travel (angle) of the lever 22 is required, along which the increased return moment (torque) must be resisted.

Adjustment of the effective lever arm length is determined significantly by the properties of the foam element 34. When the seat 4 is loaded, the foam element 34 is compressed and the seat support 14 is moved downward in the vertical direction. At the same time, the pivoting element 32 is guided along the sliding guide in the direction toward the lever fulcrum 24. As soon as the seat 4 is unloaded, the seat support 14 is pushed back into the upper initial position by the return force of the foam element 34.

The locking device is configured to fix the effective lever arm length once it has been set. It is coupled to the backrest support 12, such that the current vertical position of the seat support 14, and thus the pivoting element 32, is locked and fixed only if the synchronous mechanism is actuated, that is, if the backrest 2 is tilted. As long as the backrest 2 is not tilted, the rotatable locking element 36*b* is held in the open position by the latching element 42, against the return force of the leaf spring 40. Since the latching element 42 is formed as a lug extending upward from the backrest 2, it is pivoted out of the latching position when the backrest support 12 is moved due to tilting of the backrest 2, and the locking element 36*b* is freely moveable.

In this case, the locking element 36*b* is pivoted against the fixed locking element 36*a* by the leaf spring 40, and the vertical position is fixed. As soon as the backrest 2 is moved back into the upright position, the latching element 42 acts on the locking element 36*b* against the return force of the leaf spring 40 and forces it back into the open position. The release or latching by the latching element 42 preferably occurs here when the backrest 2 is tilted by only 2°-3° relative to the upright position of the backrest 2.

A particular advantage of the synchronous mechanism with a weight-adjusting mechanism described here for automatically adjusting the return force acting on the backrest 2 can be seen in that the principal method of operation of the synchronous mechanism is not influenced by the return force set in each case. That is, the coordinated motion paths of the seat 4 and the backrest 2, depending on the tilt of the backrest 2, are constant, independent of the weight load. In particular, this avoids having the seat 4 raised when the backrest 2 is tilted. Rather, it ensures that when the backrest 2 is tilted, the seat 4 is tilted backward and downward, just as it is for typical synchronous mechanisms without automatic weight adjustment.

A further advantage can be found in that the weight-adjusting mechanism has zero-force adjustment of the effective lever arm, due to the vertical arrangement of the lever 22 and the vertical adjustability of the seat support 14.

The invention claimed is:

1. A chair, comprising:

a synchronous mechanism having a weight-adjusting mechanism to which a return force is applied in dependence on a current weight load, said weight-adjusting mechanism having a lever and the return force is applied by said lever, an effective lever arm length of said lever is changed for adjusting the return force, said weight-adjusting mechanism automatically adjusting the effective lever arm length for the current weight load;

said synchronous mechanism having a position-adjustable pivoting element;

said lever having a fixed lever fulcrum, the effective lever arm length being defined by a distance between said fixed lever fulcrum and said pivoting element;

said synchronous mechanism further having a joint, a seat support and a backrest support connected to said seat support by said joint, said seat support and said backrest support being movably mounted in a common guide such that a distance between said pivoting element and said fixed lever fulcrum is adjusted depending on the current weight load; and wherein said pivoting element is disposed on said backrest support such that, when said synchronous mechanism is actuated, said pivoting element pushes said lever away, counter to the return force.

2. The chair according to claim 1, wherein said backrest support is rotatably mounted about a rotary axis and said pivoting element is located at a distance from said rotary axis.

3. The chair according to claim 2, wherein said rotary axis and said fixed lever fulcrum are at least generally located on a common vertical line.

4. The chair according to claim 1, wherein said lever has a contact surface for engaging said pivoting element, along said contact surface said pivoting element can be positioned to adjust the effective lever arm length.

5. The chair according to claim 1, further comprising a return element for applying the return force, said return element having a free end connected to said lever, such that when said lever is rotated, said return element is tensioned or relaxed.

6. The chair according to claim 1, further comprising a weight return element applying a return force to said seat support, directed opposite the current weight load.

7. The chair according to claim 6, wherein said weight return element has a non-linear spring characteristic.

8. The chair according to claim 1, further comprising a locking mechanism for fixing the effective lever arm length when said synchronous mechanism is actuated.

9. The chair according to claim 8, wherein said locking mechanism has a movable locking element held in an open position when said synchronous mechanism is unloaded, and said movable locking element is moved into a locked position when said synchronous mechanism is actuated.

10. The chair according to claim 1, wherein the chair is an office chair.

11. A chair, comprising:

a synchronous mechanism having a weight-adjusting mechanism to which a return force is applied in dependence on a current weight load, said weight-adjusting mechanism having a lever transmitting the return force, and wherein an effective lever arm length of said lever is changed for adjusting the return force, said weight-adjusting mechanism automatically adjusting the effective lever arm length for the current weight load;

said synchronous mechanism having a pivoting element, and a position of said pivoting element is adjustable; and said lever having a fixed lever fulcrum, the effective lever arm length is defined by a distance between said fixed lever fulcrum and said pivoting element;

said lever having a contact surface for engaging said pivoting element, along said contact surface said pivoting element can be positioned to adjust the effective lever arm length;

wherein said contact surface is generally vertical when said synchronous mechanism is not loaded.

* * * * *